US009938076B2

(12) United States Patent
Lecocq et al.

(10) Patent No.: US 9,938,076 B2
(45) Date of Patent: Apr. 10, 2018

(54) FLEXIBLE STORAGE DEVICE COMPRISING A FLEXIBLE CONTAINER AND AN INNER LINER

(71) Applicants: ROQUETTE FRERES, Lestrem (FR); SO BAG, Blanzy (FR)

(72) Inventors: Jean-Pierre Lecocq, Vaudricourt (FR); Nicolas Chevalier, Le Breuil (FR)

(73) Assignees: ROQUETTE FRERES, Lestrem (FR); SO BAG, Blanzy (FR)

( * ) Notice: Subject to any disclaimer, the term of this patent is extended or adjusted under 35 U.S.C. 154(b) by 0 days.

(21) Appl. No.: 14/908,672

(22) PCT Filed: Jul. 17, 2014

(86) PCT No.: PCT/FR2014/051836
§ 371 (c)(1),
(2) Date: Jan. 29, 2016

(87) PCT Pub. No.: WO2015/015085
PCT Pub. Date: Feb. 5, 2015

(65) Prior Publication Data

US 2016/0185521 A1 Jun. 30, 2016

(30) Foreign Application Priority Data

Aug. 2, 2013 (FR) ..... 13 57723
Feb. 14, 2014 (FR) ..... 14 51162

(51) Int. Cl.
*B65D 88/00* (2006.01)
*B65D 88/16* (2006.01)
(Continued)

(52) U.S. Cl.
CPC ..... *B65D 88/165* (2013.01); *B26F 1/10* (2013.01); *B26F 1/24* (2013.01); *B65D 81/3888* (2013.01);
(Continued)

(58) Field of Classification Search
CPC ..... B65D 88/165; B65D 81/3888; B65D 88/1618; B65D 88/54; B65D 88/741;
(Continued)

(56) References Cited

U.S. PATENT DOCUMENTS 4,424,900 A * 1/1984 Petcavich ..... B32B 15/08 206/720
4,696,765 A * 9/1987 Kakizaki ..... C08K 3/04 252/511
(Continued)

FOREIGN PATENT DOCUMENTS

DE 35 32 097 A1 3/1987
DE 102 05 599 A1 8/2003
(Continued)

OTHER PUBLICATIONS

International Search Report, dated Feb. 6, 2015, from corresponding PCT application.

*Primary Examiner* — Peter Helvey
(74) *Attorney, Agent, or Firm* — Young & Thompson

(57) ABSTRACT

A storage device (1) for bulk material intended for powdery materials, includes a flexible container (2) for bulk material and an insulating inner liner (3), of which the surface resistivity is greater than 1.0×1012Ω, without a static electricity conductive layer and without a static electricity dissipation layer, the inner lining (3) covering the inner walls of the container, the inner lining (3) including micro-perforations that pass there through, distributed over the whole surface of the inner lining (3) in such a way that the breakdown voltage of the inner liner (3) is lower than 4 kV and the breakdown voltage of the wall of the container is lower than 6 kV.

23 Claims, 6 Drawing Sheets

Figure 1:
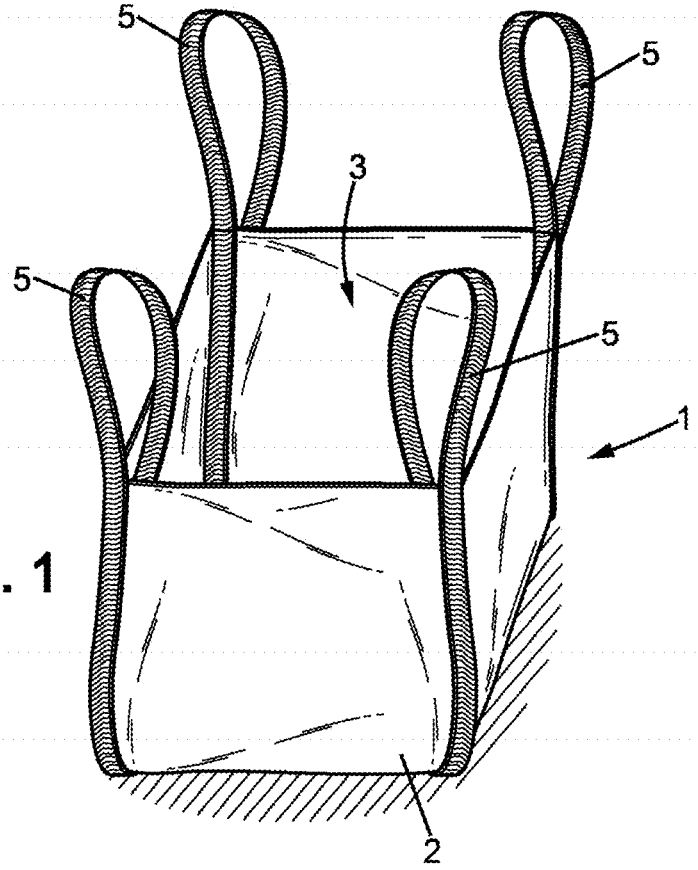

(51) Int. Cl.

| | |
|---|---|
| ***B26F 1/10*** | (2006.01) |
| ***B26F 1/24*** | (2006.01) |
| ***B65D 81/38*** | (2006.01) |
| ***B65D 88/54*** | (2006.01) |
| ***B65D 88/74*** | (2006.01) |
| *B31B 155/00* | (2017.01) |
| *B31B 160/30* | (2017.01) |
| *B31B 160/20* | (2017.01) |
| *B31B 70/14* | (2017.01) |

(52) U.S. Cl.
CPC ..... *B65D 88/1618* (2013.01); *B65D 88/54* (2013.01); *B65D 88/741* (2013.01); *B31B 70/146* (2017.08); *B31B 70/148* (2017.08); *B31B 2155/00* (2017.08); *B31B 2155/002* (2017.08); *B31B 2160/20* (2017.08); *B31B 2160/30* (2017.08)

(58) Field of Classification Search
CPC ..... B26F 1/10; B26F 1/24; B31B 2219/143; B31B 2219/148; B31B 2237/20; B31B 2237/25; B31B 2237/50
USPC ..... 383/101–103
See application file for complete search history.

(56) References Cited

U.S. PATENT DOCUMENTS 4,746,574 A * 5/1988 Hattori ..... B32B 27/18 206/720
4,875,581 A * 10/1989 Ray ..... H01L 23/60 206/720
5,073,421 A * 12/1991 Akao ..... B32B 7/02 428/212
5,097,949 A * 3/1992 Heldwein ..... B32B 7/02 206/524.2
5,124,075 A * 6/1992 Yasuda ..... H01B 1/24 252/511
5,174,924 A * 12/1992 Yamada ..... C08K 3/04 252/502
5,213,736 A * 5/1993 Sumita ..... C08K 3/04 252/500
5,514,299 A * 5/1996 Kalwara ..... B65D 90/46 220/23.87
5,741,208 A * 4/1998 Moak ..... B65F 1/06 493/195
5,759,649 A * 6/1998 Dinter ..... B32B 7/02 206/524.4
5,762,421 A * 6/1998 Ross ..... B65D 88/1618 383/111
5,865,541 A * 2/1999 Lafleur ..... B65D 88/1618 383/105
5,877,932 A * 3/1999 Hauck ..... G01M 3/186 361/212
6,139,482 A * 10/2000 Lafleur ..... B65D 88/1618 493/210
6,207,592 B1 * 3/2001 Nickell ..... B29C 47/0019 427/203
6,331,334 B1 * 12/2001 Trepte ..... B32B 3/30 206/484
6,374,579 B1 * 4/2002 Muller ..... B65D 88/1618 383/120
6,986,730 B1 * 1/2006 Hoekstra ..... A61L 2/206 206/363
7,325,699 B2 * 2/2008 Etheridge ..... A47K 10/38 15/1
7,390,553 B2 * 6/2008 Muth ..... A61F 13/512 428/132
7,665,672 B2 * 2/2010 Kosmyna ..... B05B 7/2408 220/495.02
7,677,462 B2 * 3/2010 Hynes ..... G06K 19/06196 235/487
7,766,250 B2 * 8/2010 Kosmyna ..... B05B 7/2408 220/495.02
9,498,936 B2 * 11/2016 Douglas ..... B32B 27/08
9,498,937 B2 * 11/2016 Blemberg ..... B32B 27/08
2004/0120612 A1 * 6/2004 La Fleur ..... B65D 88/1618 383/111
2005/0031231 A1 2/2005 Eisenbarth et al.
2005/0186392 A1 * 8/2005 Fontaine ..... B26D 7/14 428/131
2007/0201774 A1 * 8/2007 Plunkett ..... B65D 31/02 383/109
2008/0273820 A1 * 11/2008 Wiker ..... B29D 7/01 383/103
2010/0192998 A1 * 8/2010 Villers ..... B65D 88/1606 135/96
2010/0224520 A1 * 9/2010 Kohen ..... B65D 19/385 206/386

FOREIGN PATENT DOCUMENTS

EP 0 443 319 A2 8/1991
EP 0 699 599 A1 3/1996
EP 2 218 656 A1 8/2010

* cited by examiner

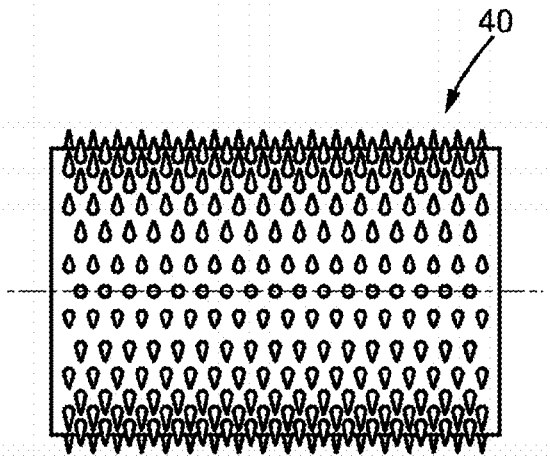
FIG. 3
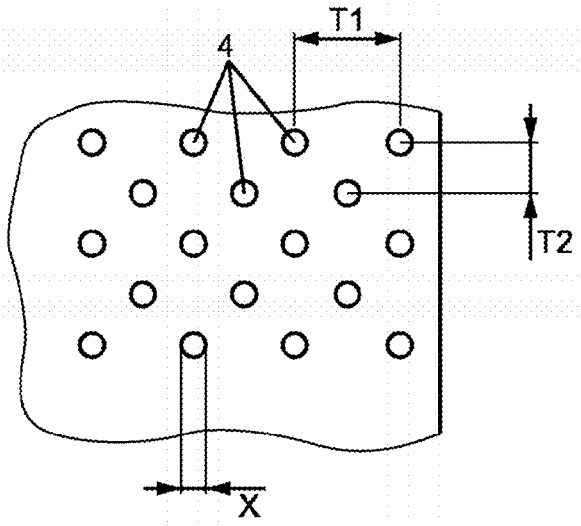
FIG. 4
| | | |
|---|---|---|
| T1 | 20 | mm |
| T2 | 20 | mm |
| X | 0.1-0.4 | mm |
FIG. 5

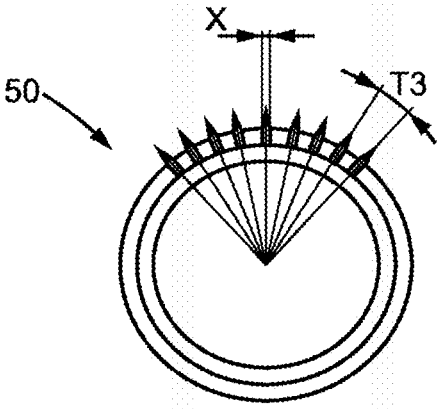
FIG. 7a
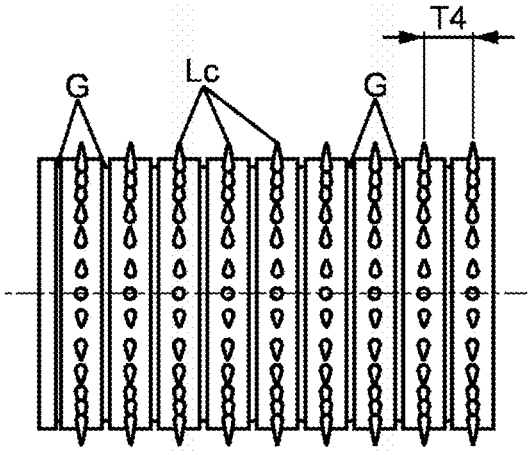
FIG. 7b
| | | |
|---|---|---|
| T4 | 16 | mm |
| T3 | 8 | mm |
| X | 0.08-0.32 | mm |
FIG. 8

FLEXIBLE STORAGE DEVICE COMPRISING A FLEXIBLE CONTAINER AND AN INNER LINER

The invention relates to a flexible storage device comprising a flexible container and a liner.

The field of the invention is that of large flexible bulk containers, or FIBCs (Flexible Intermediate Bulk Containers), also usually called "Big Bags".

Such flexible bulk packagings are commonly used for the storage and transportation of powdery or granular materials. The container is generally constructed in parallelepipedal form, with a volume ranging generally from 0.5 to 3 $m^3$. This container is a flexible structure with a mechanical strength that makes it possible to take up the load of the stored materials.

The container is conventionally obtained from fabric of polymer fibers (PP, PE, PET, etc.), often permeable to products of small granule sizes. In order to avoid the passage of the powdery materials through the fabric, it is known practice to use a inner liner, also called "protective inner covering" in the standard IEC 61340 4-4 Edition 2.0. During operations for filling or emptying such packagings, the frictions between the material and the packaging generate an electrostatic charge on the packaging and/or on the material.

In the presence of an explosive atmosphere, particularly when fine particulates are in suspension in the air, the electrostatic discharges which can result therefrom represent a risk of explosion and/or of flames, by the inflammation of these powders.

In order to avoid these risks, it is known practice from the standard IEC 61340 4-4 Edition 2.0 to classify the packagings according to their construction, the nature of their operation, and their performance requirements with regard to these risks. The FIBCs are classified in one of the following four types: type A, type B, type C and type D.

In particular, the FIBCs of type B are designed in plastic material to avoid certain discharges and discharge propagations, without requiring earthing. Such FIBCs are suitable for explosive atmospheres formed by clouds of fine particulates in suspension, but are not suited to gaseous explosive atmospheres.

The FIBCs of type C are designed with a conductive sheet, of fabric or of plastic or woven with conductive threads or filaments, and are designed to prevent the occurrence of incendiary sparks, of discharge and of propagation of certain discharges. In such an FIBC of type C, a greater protection is obtained against the risks of explosion by comparison with an FIBC of type B. The FIBCs of type C are suitable for explosive atmospheres formed by clouds of fine particulates in suspension, and also for explosive atmospheres of a gaseous nature.

On the other hand, this protection is assured only if the conductive sheet or equivalent is linked to the earth, at least during filling and emptying operations.

However, and according to the observations of the inventor, in practice, it is not uncommon for the operators to forget to earth the storage device during filling or emptying operations, which can prove particularly hazardous.

Finally, the FIBCs of type D are made of a fabric protected against static electricity, designed to prevent the occurrence of sparks and of certain discharges, without requiring the FIBC to be connected to the earth.

Conventionally, in the FIBCs of type B, C or D, protective inner coverings are used that are of type L2 according to the abovementioned standard, with materials exhibiting a surface resistivity of between $1.0\times10^9\Omega$ and $1.0\times10^{12}\Omega$. Such materials, with dissipative effect, comprise antistatic additives whose effect is however of limited duration in time. The life of such an inner covering does not exceed 2 years. Furthermore, these additives are likely to migrate and come into contact with the stored product, and therefore contaminate it. This is a problem that is often considered prohibitive in the case of use of the storage device for food applications, and above all pharmaceutical applications. This is why, these days, to the knowledge of the inventor, those skilled in the art use, for these sensitive applications, almost always, an FIBC of type C, without an inner covering of type L2 over which a covering of type L1 is preferred that requires earthing.

Thus, from the document EP 0699599A1, a storage device is known which comprises, a gas-tight outer layer, referenced 8, an electrically conductive intermediate layer, referenced 6, and a polymer inner layer, referenced 4, having openings 5. The discharging of such a device and the safeguarding thereof with respect to the risks of explosion are ensured only when the conductive intermediate layer, referenced 6, is linked electrically to the earth. In order to facilitate the transfer of the electrical charges, from the material to the electrically conductive layer, the inner layer, referenced 4, comprises perforations of relatively large diameter of between 0.2 mm and 10 mm. Such a device can be used as inner liner in the embodiment of FIGS. 4 and 5. The storage device of this prior art does not meet the criteria to be qualified as type B classified flexible intermediate bulk container according to the standard 61340-4-4 Edition 2.0 2012-01 in that it comprises an electrically conductive layer. In such a device, the protection with regard to the risks of explosion is ensured only if the conductive layer of this prior art is linked electrically to the earth.

Also known, from the document U.S. Pat. No. 6,331,334 B1, is a flexible inner liner for a flexible intermediate bulk container. According to an essential characteristic of this prior art, these micro-perforations do not pass entirely through the layer, ensuring the sealing of the layer, on the one hand, and keeping the breakdown voltage at a sufficiently low level, on the other hand.

Also known, from the document US 2005/0031231, is a "type B" storage device which comprises a textile container made of polypropylene material, referenced 10, and a inner liner 20. According to this prior art, the inner liner ("inner liner 20") is the film of Basell Polyolefins under the trademark "ADLFEX Q 100 F". The choice of this specific material would, according to page 1, column 2, make it possible to satisfy a breakdown voltage lower than 4 kV. It will be noted that, in all the tests provided, the thickness of the film, which is 1.5 mill PP (i.e. 38 micrometers), corresponds to a very small wall thickness for an inner liner, close to the wall thickness for which this breakdown voltage limit is always satisfied.

From the state of the art of flexible intermediate bulk containers it is known practice, in order to de-aerate the storage device, in particular during filling steps, to provide micro-perforations that pass through the inner liner, for example from the document EP 2 218 656 A1. These micro-perforations are permeable to gas and normally impermeable to the materials stored.

To the knowledge of the inventor, none of these storage devices with perforated inner liner satisfies the breakdown voltage limit for the inner liner in order for these devices to be able to qualify as type B according to the abovementioned standard, for the following reasons:

- to the knowledge of the inventor, in the devices known to the inventor, these micro-perforations intended for de-aeration are provided only on the inner liner, in certain local areas, very often only at the corners, and not over all the surface of this liner, the density of the perforations is not generally sufficient to make it possible to adequately dissipate the electrostatic charges to the level required to satisfy the above-mentioned standard.

When the sole objective is to de-aerate the storage device, a person skilled in the art is moreover persuaded against increasing the density of the micro-perforations and/or providing micro-perforations over all the surface of the inner liner, inasmuch as these through micro-perforations have a commensurately the greater effect on the mechanical strength (notably resistance to tearing) of the inner liner.

The aim of the present invention is to propose a device intended for the storage of powdery products, offering effective protection against the risks of explosion, in particular during bag emptying and/or filling operations.

More particularly, the aim of the present invention is to propose such a device which does not require earthing during emptying and/or filling operations in order to observe the safety conditions.

Another aim of the present invention is to propose such a packaging which does not expose the product stored to risks of contamination by migration from the container to the content.

Another aim of the present invention is to propose such a packaging which ensures protection against the risks of explosion, advantageously without the packaging being dependent on a particular material for the inner liner.

Other aims and advantages of the present invention will become apparent from the description which is given purely by way of indication and the aim of which is not to limit same.

Thus, the invention relates to a packaging comprising a flexible bulk container, the material of the container being an insulator, without antistatic additive or electrically conductive layer, as well as an insulating inner liner, of surface resistivity greater than $1.0\times10^{12}\Omega$, covering the inner walls of the container, without a static electricity conducting layer and without a static electricity dissipation layer.

According to the invention, the inner liner comprises micro-perforations, that pass therethrough, distributed over the whole surface of the inner liner and in such a way that the breakdown voltage of the inner liner is lower than 4 kV and in that the breakdown voltage of the wall of the container is lower than 6 kV, without requiring the device to be earthed.

Such a storage device according to the invention can be qualified as a flexible intermediate bulk container classified as type B according to the standard 61340-4-4 Edition 2.0 2012-01.

According to features of the invention, taken alone or in combination:

the inner liner consists of a single film of material, having said micro-perforations, or else is a multilayer of several different insulators;

the flexible bulk container is formed from fabric;

the fabric is a coated fabric;

the fabric is a laminated fabric;

the fabric is a bare fabric (non-laminated, non-coated), the density of the micro-perforations over the whole surface of the covering is such that two neighboring micro-perforations are separated by a distance less than or equal to 2 cm, preferably between 0.5 cm and 2 cm;

the diameter of the micro-perforations is between 5 microns and 130 microns, the maximum surface area not having any micro-perforations must not exceed the surface area of a disk of 2.5 cm diameter, even 2 cm in diameter, the thickness Δ of the inner liner is between 20 microns and 700 microns, preferably at least equal to 90 microns.

According to an advantageous embodiment, the fabric of the flexible bulk container is a fabric permeable to air, preferably non-laminated and non-coated, so as to allow the de-aeration of the packaging through the micro-perforations of the inner liner and the fabric of said container.

According to other optional features of the invention, taken alone or in combination:

the container forms a body comprising a bottom wall, four side walls and a roof, said device comprising a flexible filling chute, fixed to the roof, extending from an opening of the roof, outside the body, and a flexible emptying chute, extending from an opening of the bottom wall, outside the body and in which the perforated inner liner covers not only the inner walls of the body of the container, but also the inner wall of the filling chute and the inner wall of the emptying chute;

the perforated inner liner covering not only the inner walls of the body of the container, the inner wall of the filling chute and the inner wall of the emptying chute consists of a gusset sheath, of a single piece, extending lengthwise, from the filling chute to the emptying chute;

the density of the micro-perforations over the inner liner is between 0.2 perforations per $cm^2$ and 2 perforations per $cm^2$;

the distribution of the micro-perforations over the inner liner is uniform;

the micro-perforations are arranged in parallel lines, the micro-perforations of each line being separated by a constant distance between any two successive micro-perforations of the line, and the perforations of two successive lines being arranged staggered relative to one another; alternatively, the micro-perforations of the different lines can be aligned;

the material of the container and/or the material of the inner liner are chosen from polyethylene, polypropylene, polyamide and PET, even a biosourced polymer (a biopolymer).

The storage device is particularly applicable as a type B flexible intermediate bulk container, according to the standard IEC 61340-4-4 Edition 2.0 2012-01.

The invention also relates to a method for manufacturing a storage device according to the invention in which the micro-perforated inner liner is obtained from a non-perforated inner liner, and by means of a perforation device comprising at least one roller provided, on its circumference, with needles, driven in rotation about its axis and rolling over the inner liner while perforating same.

According to one embodiment, the perforation device comprises two contra-rotating rollers, each provided with needles on its circumference, driven in counter rotations, the two rollers rolling over the inner liner while perforating same.

According to one embodiment, the micro-perforations are produced from a gusset sheath, directly in the gusset sheath, when the sheath is flat, in the form of a strip.

Figure 2:
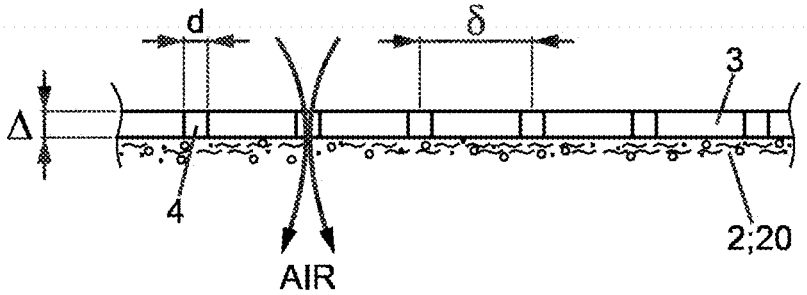
Figure 6:
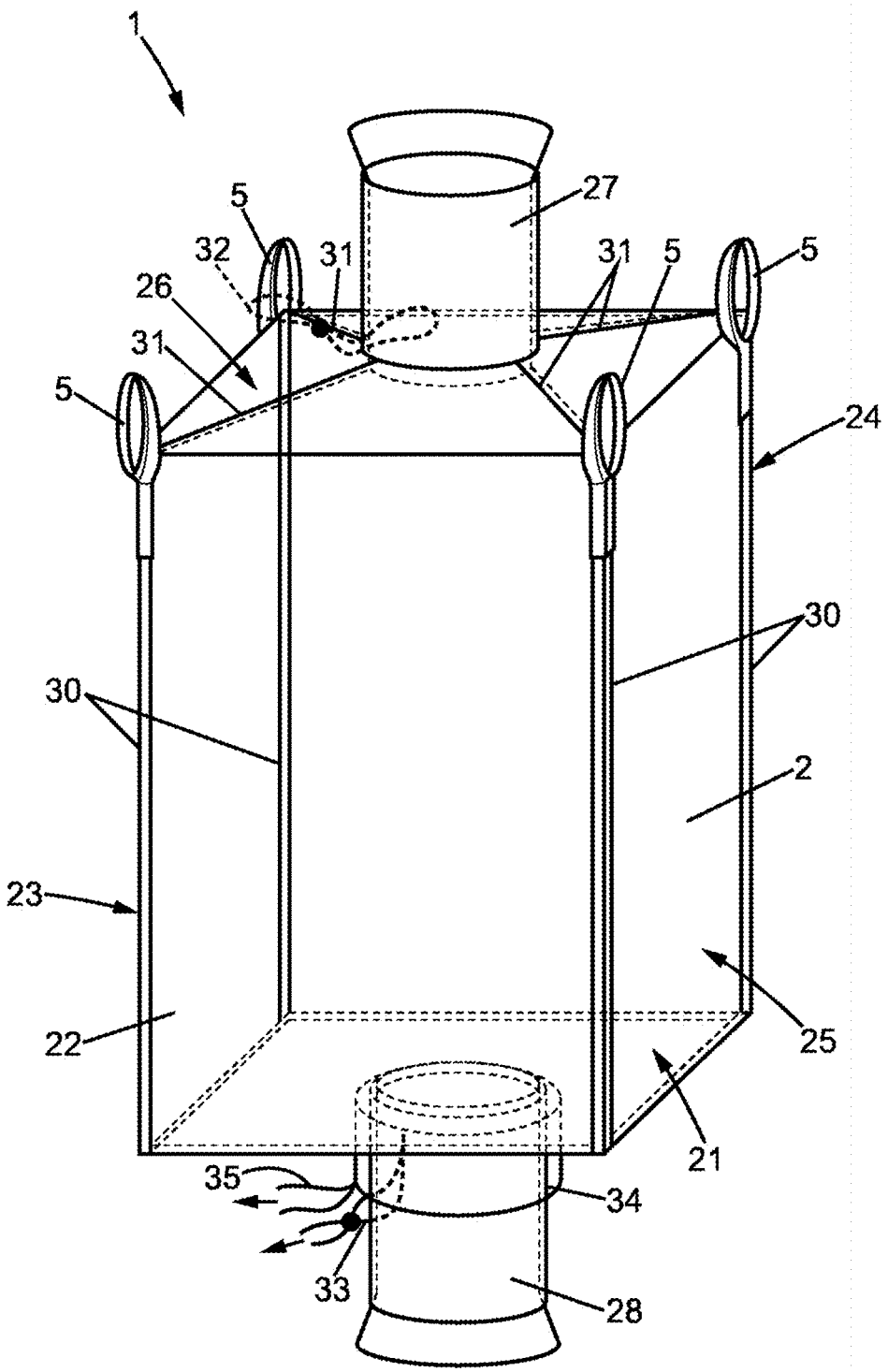
Figure 9A:
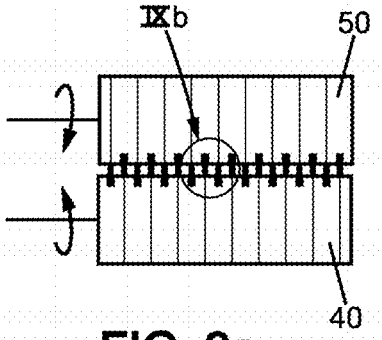
Figure 9B:
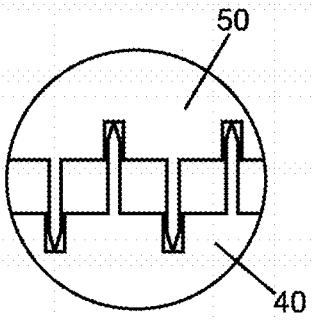
Figure 10A:
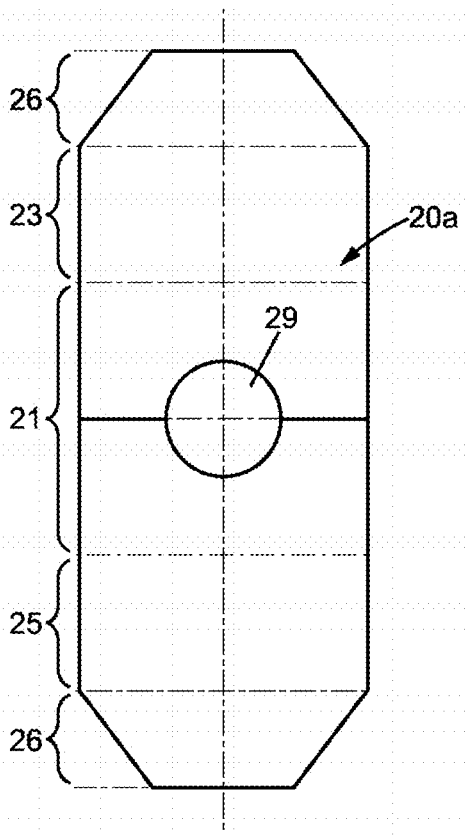
Figure 10B:
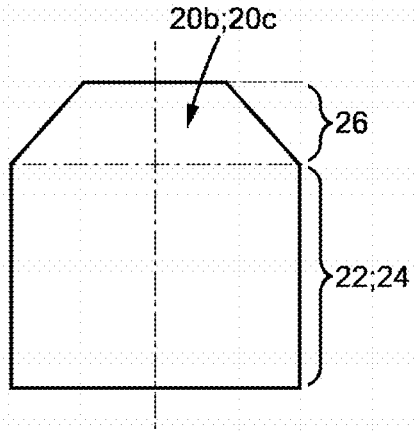
Figure 11A:
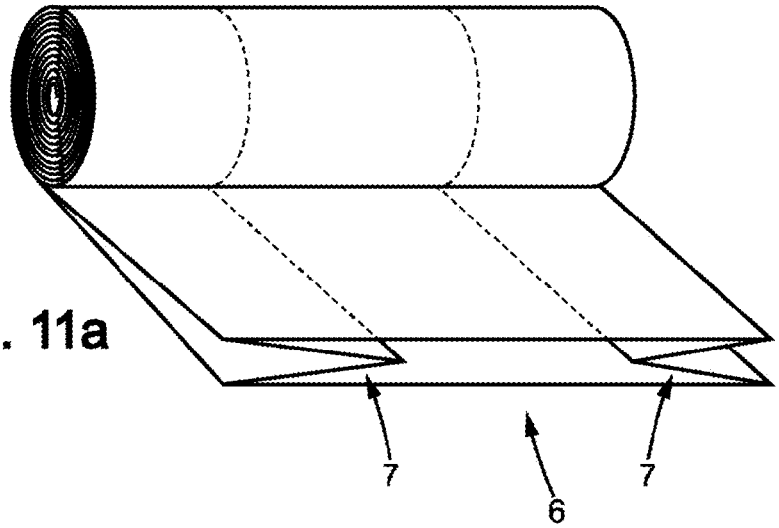
Figure 11B:
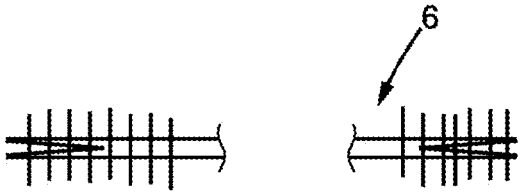
Figure 12:
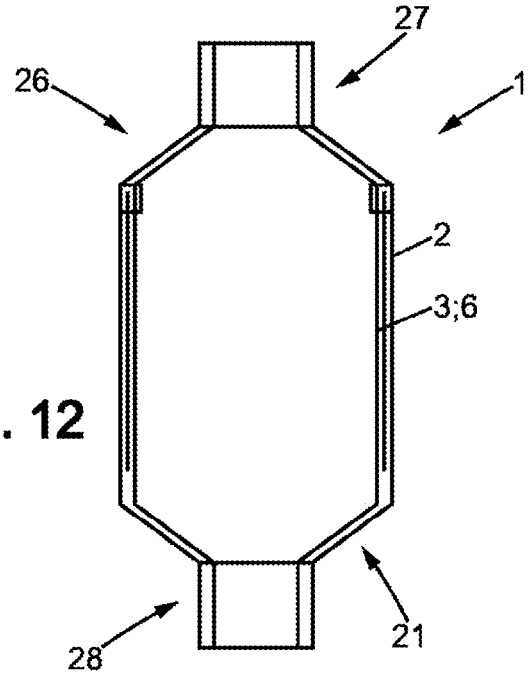

The invention will be better understood on reading the following description accompanied by the attached drawings in which:

FIG. 1 is a schematic view of a storage device according to the invention according to one embodiment, FIG. 2 is a cross-sectional view of the wall of the container and of the wall of the protective inner covering, FIG. 3 is a schematic view of a roller provided with needles of a perforation device with a single roller with needles, FIG. 4 is a schematic view of the configuration of the perforations obtained on the inner liner using the device of FIG. 3, FIG. 5 is a table illustrating the values of the dimensions referenced in FIG. 4, FIG. 6 is a flexible intermediate bulk container according to the invention according to a second embodiment, FIGS. 7*a* and 7*b* are side and front view of a roller provided with needles of a perforation device with two contra-rotating rollers, according to another variant embodiment, FIG. 8 is a table illustrating the values of dimensions referenced in FIGS. 7*a* and 7*b*, FIG. 9*a* is a schematic view of a perforation device with contra-rotating rollers, the two rollers of which each consist of a roller according to FIGS. 7*a* and 7*b*, FIG. 9*b* is detailed view of FIG. 9*a* illustrating, in the area of interface between the two rollers of the perforation device, the interpenetration between the rollers with needles, and more particularly, the penetration of the needles of each roller in depthwise-circular grooves of the cylindrical surface of the other roller, FIGS. 10*a* and 10*b* are views of the two fabric formats that make it possible to manufacture the body of the container illustrated in FIG. 6. Also, the invention relates to a bulk storage device 1, intended for the transportation and storage of powdery materials, FIG. 11*a* is a view of a reel of a gusset sheath, a sheath typically obtained by extrusion blow molding, and intended to form the inner liner, FIG. 11*b* illustrates the production of the micro-perforations from the gusset sheath illustrated in FIG. 11, directly in the gusset sheath, when the sheath is flat, in the form of a strip, FIG. 12 illustrates a storage device of which the container comprises four side walls, a bottom, a roof, the device having a filling chute and an emptying chute, the inner liner, covering the inner walls of the filling chute, of the container and of the emptying chute, consisting of the micro-perforated gusset sheath, extending lengthwise, of a single piece, from the filling chute to the emptying chute.

Said device comprises a flexible bulk container 2, and a inner liner 3. The container 2 forms a flexible structure with a mechanical strength that makes it possible to take up the load of the material stored. The container 2 can be of a substantially parallelepipedal form, with a volume of between 0.5 $m^3$ and 3 $m^3$, as a nonlimiting example.

Optionally, and conventionally, this structure can be provided with handling straps 5, at the corners of the structure.

This structure can be formed essentially from a synthetic, in particular polypropylene-based fabric base.

The inner liner is an insulator, that is to say of surface resistivity greater than $1.0\times10^{12}\Omega$, on its inner face and on its outer face, according to the standard IEC 61340-4-4 Edition 2.0 2012-01. The inner liner is an inner protective covering of Type L3 according to the abovementioned standard.

This inner liner 3 has no electrically conductive layer. Electrically conductive layer should be understood to mean any element, for example in the form of a sheet or filament, exhibiting a surface resistivity lower than $1.0\times10^{7}\Omega$.

Thus, and according to the standard IEC 61340-4-4 Edition 2.0 2012-01, such a inner liner 3, and more generally the storage device 1 as a whole, does not require earthing, in particular during operations of filling the device with or emptying the device of powdery materials.

Furthermore, and according to the invention, the inner liner 3 is without any static electricity dissipation layer. Dissipation layer should be understood to mean a material whose surface resistivity is between $1.0\times10^{9}\Omega$ and $1.0\times10^{12}\Omega$ and which, to this end, conventionally comprises antistatic additives likely to contaminate the stored material. Thus, and according to the invention, such risks of contamination are avoided inasmuch as the inner liner is without any such additives, for example made of a non-treated plastic material.

As a nonlimiting example, the inner liner 3 consists of a single film of material having said micro-perforations 4, made of non-treated plastic material, such as, for example, polypropylene or polyethylene (PE). According to another embodiment, the inner liner can comprise a number of layers of distinct insulating materials, for example a number of plastics. For example, the inner liner 3 is a multilayer (i.e. double layer, triple layer, even more) of a same plastic, of PE for example, in order to increase the mechanical performance of the inner liner 3. Alternatively, the inner liner can be a multilayer (i.e. double layer, triple layer, even more) of a number of different insulators, such as a number of distinct plastics. This multilayer is obtained by extrusion, in particular co-extrusion. The thickness Δ of the inner liner 3 can be between 20 microns and 700 microns, preferably greater than 60 microns, and for example between 90 microns and 500 microns (μm).

According to the invention, the inner liner 3 covers the inner walls of the container 2, said inner liner 3 comprising micro-perforations 4, preferably passing therethrough.

These micro-perforations 4 are distributed over the whole surface of the inner liner 3 and in such a way that the breakdown voltage of the inner liner 3 is lower than 4 kV. Furthermore, and according to the invention, the breakdown voltage of the wall of the container is lower than 6 kV.

Such a storage device 1 can be considered as a flexible intermediate bulk container classified as type B according to the standard IEC 61340-4-4 Edition 2.0 2012-01.

According to one embodiment, the breakdown voltage of the container 2/inner liner 3 assembly is lower than or equal to 6 kV, and preferably lower than or equal to 4 kV.

According to the invention, the micro-perforations 4 are distributed over the whole surface of the inner liner 3, and not over only a part of its surface, in such a way as to avoid strong build-ups of electrostatic charges on the inner liner 3. Preferably, the density of the micro-perforations 4 on the surface of the inner liner 3 is such that two neighboring micro-perforations are separated by a distance δ less than or equal to 2 cm, preferably between 0.5 cm and 1.5 cm. Preferably, the maximum surface area not having micro-perforations should not exceed a disk of 2.5 cm diameter, even a disk of 2 cm diameter.

The diameter d of the micro-perforations 4 can be between 5 microns and 130 microns, and for example between 5 microns and 40 microns (μm). The diameter of the micro-perforations 4 will be chosen as a function of the granule size of the material to be stored and in such a way as to avoid the material passing through the inner liner 3. To this end, the micro-perforations 4 are preferably of a diameter less than the granule size of the material to be stored.

These micro-perforations of the inner liner 3 can be obtained mechanically, for example by means of a matrix provided with needles intended to perforate the liner, or else by means of a roller, provided on its circumference with such needles, designed to roll over the liner while perforating same. The material of the container 2, in particular the fabric 20 of the container, is an insulator within the meaning of the above-mentioned standard, for example polypropylene-based, without antistatic additive, or electrically conductive layer. According to one embodiment, the fabric 20 is a coated fabric, or else a laminated fabric. According to an advantageous embodiment, the fabric 20 of the flexible bulk container is a fabric permeable to air, preferably non-laminated and non-coated, so as to allow the device 1 to be de-aerated through the micro-perforations 4 of the inner liner 3 and through the fabric 20 of said container, in particular during operations of filling the device with the materials. Such a phenomenon is illustrated by the arrows in FIG. 2. Such a de-aeration makes it possible to minimize the quantity of the fine particulates placed in suspension in the air during the filling operations, and thus to limit the risks of creation of an explosive atmosphere. Such an arrangement helps, with the minimization of the breakdown voltages of the inner liner 3 and of the container, to provide better safety with respect to risks of explosion during operations of filling the device with powdery materials.

It should be noted that the values mentioned above, in particular of surface strengths and of breakdown voltage, are measured in accordance with the standard IEC 61340-4-4 Edition 2.0 2012-01.

EXAMPLE 1: BREAKDOWN VOLTAGE TEST ON PERFORATED INNER LINER, ALONE

Tests were conducted on a single-material polyethylene-based inner liner. This liner has an average thickness of 90 microns (μm) and is insulating within the meaning of the standard IEC 61340-4-4 Edition 2.0 2012-01, that is to say of surface resistivity greater than $1.0\times10^{12}\Omega$.

This inner liner was micro-perforated over the whole of its surface with a perforation density equal to 0.3 perforation per $cm^2$. The distribution of the perforations is homogenous (uniform), and obtained by means of a perforation device implementing a roller 40 provided on its circumference with needles intended to pass right through the thickness of the inner liner.

This roller 40 makes it possible to perforate the inner liner, when driven by a rotation about its axis, by rolling over the inner liner.

The needles are distributed over the roller 40, along a plurality of generatrices of the cylinder (the roller), that is to say along a plurality of straight lines, parallel to the axis of the cylinder and passing through the cylindrical surface of the roller, the straight lines being evenly offset angularly about the axis of the roller. The needles of a same generatrix are distributed in the direction of the generatrix, parallel to the axis of the roller, with a constant distance between any two successive needles of the line.

Moreover, and as illustrated in FIG. 3, the needles of one generatrix are arranged staggered relative to the needles of the neighboring generatrix.

The diameter of the needles is 0.79 mm, which makes it possible, given the elasticity of the material and the associated retraction phenomenon, to obtain micro-perforations in the liner of diameter, referenced "X", of between 0.1 mm and 0.4 mm. In effect, when the needles exit from the inner liner, the material tends to retract, reclosing the micro-perforations created.

The arrangement of the micro-perforations thus created on the liner is illustrated in FIG. 4: The micro-perforations are distributed along a plurality of parallel lines, successively spaced apart by a dimension T2, equal to 20 mm. On each line, the micro-perforations are evenly spaced apart, two successive micro-perforations being spaced apart by a dimension T1, equal to 20 mm. The perforations of two successive lines are arranged staggered, as illustrated.

This duly perforated inner liner was subjected to a breakdown voltage measurement, by Swissi Process Safety GmbH in Basle, on behalf of the present applicant, performed in the electrostatic laboratory, under the seal of confidentiality. The breakdown voltage was measured with a high-voltage device according to the standard EN 60243 and the standard IEC 61340-4-4 Ed. 2. This measurement was obtained in a climate-controlled chamber at a temperature of 23° C. and with a humidity of 20%, in accordance with the standard IEC 61340-4-4 Ed. 2. The measured breakdown voltage is 1.3 kV (±0.1). This test was the subject of a confidential report between the applicant and Swissi Process Safety GmbH.

This breakdown voltage of the inner liner is well below the tolerated maximum breakdown voltage (4 kV) that the inner liner must satisfy in order to observe the definition of flexible intermediate bulk container classified as type B according to the standard 61340-4-4 Edition 2.0 2012-01.

EXAMPLE 2: TEST OF QUALIFICATION OF AN FIBC ACCORDING TO THE CLASSIFICATION OF THE STANDARD 61340-4-4 EDITION 2 2012-01

Tests were carried out on a storage device according to the invention, more particularly a flexible intermediate bulk container (FIBC) as illustrated in FIG. 6.

This FIBC comprises a container 2, based on polypropylene fabric and manufactured flat. The body of the container comprises a bottom wall 21, with a flat bottom, substantially rectangular side walls 22 to 25, and a roof 26, of frusto-conical form.

The body of the container is obtained by the assembly of three fabrics 20*a*, 20*b* and 20*c*, stitched together by their edges.

The template for the fabric 20*a* is illustrated in FIG. 10*a*, this fabric forming the bottom wall 21 and two opposing side walls 23,25, and, partially, the roof 26. In the FIBC, this fabric is folded generally into a U shape.

The template for the fabrics 20*b* and 20*c* is illustrated in FIG. 10*b*. These two fabrics 20*b* and 20*c* are intended to form, respectively, the other two opposing side walls 22, 24 of the FIBC. The polypropylene used for the fabrics 20*a*, 20*b* and 20*c* forming the side walls, the bottom and the roof have a minimum basis weight of 165 g/m2. The dimensions of the body of the container are approximately 95×95×115 (cm).

Four gripping straps 5, in the form of loops, are fixed by stitching, respectively, at the vertical edges 30 of the container 2.

This FIBC also comprises an external filling chute 27, and an emptying chute 28.

The flexible filling chute 27 extends outside the body of the container 2, from a central opening of the roof 26 and more particularly at the small base of the frustum. This flexible chute is produced based on fabric, more particularly on polypropylene having a basis weight of at least 75 g/m$^2$. This filling chute 27 is fixed by stitching between the roof 26 and the chute. The free end of this filling chute 27 is intended to be mounted on a feed opening nozzle of a filling device (not illustrated). This filling chute 27 makes it possible to conduct (without loss) the materials from the feed opening of the filling device to the internal volume of the body of the container 2. It is extended by an internal filling chute (not illustrated). A closing tie, referenced 32, situated at the base, makes it possible to close the filling chute 27 on itself, once the filling operations are finished.

The flexible emptying chute 28 extends from a central opening 29 on the bottom wall 21, fixed by stitching thereto. It makes it possible to conduct the materials to be emptied when open to its top part. In other words, this emptying chute 28 is closed on itself by means of a flexible closing tie 33, provided at the stitching between the bottom and the chute. Once this flexible tie 33 is tightened, the emptying chute 28 is closed.

When not used, the flexible emptying chute 28 can be folded on itself and gathered up on the underside of the bottom wall 21 by means of a protective pouch 34, equipped with a drawstring 35. The protective pouch 34, made of polypropylene fabric, is a tubular part fixed at its top part by stitching to the bottom wall 21, the tubular part surrounding the emptying chute 28 over only part of the height thereof. This protective pouch 34 makes it possible to keep and compress the emptying chute between the bottom wall 21 and the pouch 34, when the drawstring 35 provided at its bottom end is actuated.

The storage device also comprises a preformed inner liner. This inner liner covers the body of the container, namely the side walls 22 to 25, the bottom wall 21 and the roof 26. This inner liner, with an average thickness of 90 microns, extends also over the filling chute 27 and over the emptying chute 28 and is made of polyethylene.

According to the invention, this inner liner is micro-perforated over the whole of its surface, with a perforation density of 1.6 perforation per cm$^2$.

These perforations were produced by means of a perforation device with contra-rotating double rollers 50. The inner liner is then perforated by the needles of the two rollers when passing between the rollers. A drive mechanism makes it possible to control and synchronize the rotation speeds of the two rollers 50.

The two rollers 50 are each identical to that illustrated in FIGS. 7*a* and 7*b*. The needles are distributed, along a number of circular lines Lc, and circular grooves G, contained in planes parallel to the circular lines, being provided depthwise from the cylindrical surface of the roller, at least between the circular lines and in the same number as the lines of needles Lc.

The perforation device results from the association of two rollers according to FIGS. 7*a* and 7*b* mounted contra-rotating, of mutually parallel axes, the two needle rollers being arranged relative to one another in an interpenetrating manner: more particularly, and as illustrated in FIG. 9*b*, the needles of each roller penetrate into the circular grooves depthwise from the cylindrical surface of the other roller, in the area of interface between the two rollers.

According to table of FIG. 8, two successive circular lines of needles are separated by a distance T4 equal to 16 mm. On each circular line, two successive needles are separated by a distance T3 equal to 8 mm.

By angularly offsetting the two rollers, it is possible to perforate the inner liner according to a staggered arrangement similar to that of FIG. 4. The density of the needles on each roller is 0.8 needle per cm$^2$.

With the liner being perforated by the two rollers, the density of the micro-perforations on the liner is 1.6 perforation per cm$^2$. According to the production implemented, the diameter of the needles is 0.62 mm which makes it possible to create perforations of a diameter of between 0.08 mm and 0.32 mm given the retraction phenomenon.

Such an FIBC was tested by Swissi Process Safety GmbH in Basle, on Oct. 17, 2013 on behalf of the applicant, performed in the electrostatic laboratory, and under the seal of confidentiality.

The results of the test confirm that the FIBC conforms to the requirements of the abovementioned standard 61340-4-4 to be qualified type B:

- the measured breakdown voltage of the container is lower than 6 kV,
- the inner liner, perforated over the whole of its surface, is of type L3 within the meaning of the standard and its breakdown voltage is lower than 4 kV. The surface resistivity is greater than 1$^e$12 Ohm.

The breakdown voltage was measured with a high-voltage device according to the standard EN 60243 and the standard IEC 61340-4-4 Ed. 2. This measurement was obtained in a climate-controlled chamber at a temperature of 23° C. and with a humidity of 20%, in accordance with the standard IEC 61340-4-4 Ed. 2. The measurement of the voltage is 1000 V.

The table below brings together the measurements carried out:

| Tested part of the FIBC | Value | Unit |
|---|---|---|
| Filling chute | 3.9 (±0.1). | kV |
| Roof | None (*) | kV |
| Side wall No. 1 | 2.3 (±0.1). | kV |
| Side wall No. 2 | 2.4 (±0.1). | kV |
| Side wall No. 3 | 2.3 (±0.1). | kV |
| Side wall No. 4 | U-Profile (*) | kV |
| Emptying chute | 3.4 (±0.1). | kV |
| Perforated inner liner | 1.3 (±0.1). | kV |
| Surface resistivity (internal) | (1.7 ± 0.3)e12 | Ohm |
| Surface resistivity (external) | (2.8 ± 0.9)e12 | Ohm |

(*) It should be noted that the Swissi Process Safety table, reproduced and translated above, brings together three breakdown voltage measurements for the body of the container ("Side wall No. 1", "Side wall No. 2" and "Side wall No. 3"), these three measurements being performed respectively on the three fabrics 20a, 20b and 20c. The "side wall No. 4" was not the subject of a measurement because it was formed from the same fabric 20a, of generally U shape ("U-profile") as the "side wall No. 2": this measurement would be redundant. The side wall No. 4 is tested with the side wall No. 2.

For the same reason, the roof, consisting of the trapezoid parts of the three fabrics 20*a*, 20*b* and 20*c* was not the subject of a specific measurement, because this measurement would depend on the point at which it was performed and would be redundant.

The confidential report issued by Swissi Process Safety confirms that the FIBC tested conforms to the requirements of the abovementioned standard 61340-4-4 to be qualified type B.

General:

Generally, the storage device can be of the type of that exemplified above in which the container forms a body comprising a bottom wall 21, four side walls 22 to 25 and a roof 26, said device comprising a flexible filling chute 27, fixed to the roof 26, notably in the form of a truncated pyramid or frustum, extending from an opening of the roof, outside the body, and a flexible emptying chute 28, extending from an opening of the bottom wall 21, outside the body.

The body of the container can be made up of three fabrics 20*a*, 20*b*, 20*c* of the type of that illustrated in FIGS. 10*a* and 10*b*. Alternatively, other productions are possible, for example by providing a distinct fabric for each roof, bottom or side wall.

The filling chute 27 and the emptying chute 28 are typically provided with their closing ties 32 and 33. The device can comprise said pouch 34, with its drawstring 35, the function of which was described above.

The micro-perforated inner liner 3 covers not only the inner walls of the body of the container but also the inner wall of the filling chute 27 and the inner wall of the emptying chute 28.

In such a type of device, the possibility offered by the micro-perforations 4 to de-aerate the internal volume of the device by allowing air to pass through these micro-perforations, even the permeable fabric of the body of the container, notably including the fabric of the chutes, is particularly advantageous and helps to provide better safety with respect to risks of explosion during operations of filling the device with powdery materials.

Generally, the material of the fabric of the container and/or of the inner liner can be a plastic chosen from polypropylene or polyethylene.

Generally, the distribution of the micro-perforations 4 on the inner liner is preferably uniform.

For example, the micro-perforations 4 are arranged in parallel lines, the micro-perforations of each line being separated by a constant distance between any two successive micro-perforations of the line. The perforations of two successive lines are staggered relative to one another. According to another alternative, they can be aligned. Generally, the distance T1 separating two micro-perforations of a line and the distance T2 separating two successive lines of perforations can each be between 5 mm and 20 mm. The distances T1 and T2 can be different or equal.

The invention relates also to a method for manufacturing a storage device according to the invention.

According to this method, the micro-perforated inner liner is obtained from a non-perforated inner liner and by means of a perforation device comprising at least one roller provided on its circumference with needles (substantially radial), driven in rotation about its axis and rolling over the inner liner while perforating same. The perforation device can comprise two contra-rotating rollers 50, each provided with needles on the circumference, driven by counter rotations and rolling over the non-perforated liner while perforating same. The rollers 50 can be those of the type of that illustrated in FIGS. 7*a* and 7*b*. The needles are distributed, along several circular lines Lc, and circular grooves G, contained in planes parallel to the circular lines Lc, being provided depthwise from the cylindrical surface of the roller, at least between the circular lines Lc and in the same number as the lines of needles Lc. The perforation device results from the association of two rollers according to FIGS. 7*a* and 7*b*, mounted to contra-rotate, of mutually parallel axes, the two rollers with needles being arranged relative to one another in an interpenetrating manner: The needles penetrate into the circular grooves G depthwise from the cylindrical surface of the other roller, in the interface and working areas between the two rollers.

Generally, the fabric (or fabrics) used for the body of the container can have a basis weight of between 140 g/m$^2$ and 250 g/m$^2$.

The fabric (or fabrics) used for the filling and emptying chutes can have a basis weight of between 50 g/m$^2$ and 200 g/m$^2$.

The inner liner can be positioned in the container, with no particular fixing between the container and the inner liner.

Alternatively, the inner liner can be fixed to the container, preferably by stitching, for example at the (four) corners of the device. Preferably, glue fixing is avoided inasmuch as the glue used to bond the inner wall of the container and the outer wall of the inner liner can fill and plug the micro-perforations and thus affect the performance levels of the inner liner with regard to the authorized limit on breakdown voltage.

Generally, the inner liner 3 can consist of a gusset sheath 6, the inner volume of which is intended to receive the material. Each gusset 7 is defined by three parallel sheath fold lines. This sheath 6 with its gussets 7 (two of them) is typically obtained by the extrusion blow molding of a polymer, then generally wound flat in a roll, as illustrated in FIG. 11*a*.

In a storage device 1 with a container 2 that comprise four side walls 22, 23, 24, 25, a bottom 21, and a roof 26, the device having a filling chute 27 and an emptying chute 28, the inner liner 3 may consist of such a micro-perforated gusset sheath 6, extending lengthwise, of a single piece and continuously, from the filling chute 27 to the emptying chute 28.

This sheath 6, of a single piece, constitutes, as illustrated in FIG. 12, the inner liner successively covering the walls of the filling chute 27, of the roof 26, the side walls of the container 2, the bottom 21, and the emptying chute 28. This sheath can be fixed notably by stitching to the container 2, notably at the four corners, and to the roof wall 26, even also the filling chute 27.

Advantageously, this micro-perforated gusset sheath 6 can be obtained from a non-micro-perforated gusset sheath by subjecting the non-perforated sheath, in a flat position (in the form of a strip), to the work of the needles of the rollers 40 or 50 of a perforation device.

It will be noted that, as illustrated schematically in FIG. 11*b*, when implementing such a method in which the gusset sheath 6 is perforated, the needles must, at the edges of the strip forming the gussets 7, pass through four thicknesses of wall of the sheath.

The inventor is to be praised for having implemented such a method for manufacturing a micro-perforated sheath by direct perforation of a non-micro-perforated gusset sheath, a method which required quite particular attention to the machine settings in order to be able to perforate the sheath, in particular at the gussets 7 and with the desired diameter of the micro-perforations.

The storage device according to the invention can be particularly applicable for the storage and/or transportation of material, in particular powdery material, in the agri-food field, notably baby food and the pharmaceutical field.

Naturally, other embodiments could have been envisaged without in any way departing from the scope of the invention as defined hereinbelow.

PARTS LIST

1. Storage device,
2. Container,
3. Liner (inner protective covering),
4. Micro-perforations,
5. Handling straps,
6. Gusset sheath,
7. Gussets
20. Fabric,

20*a*. Fabric (fabric forming the bottom wall 21, two side walls 23 and 25 and, partially, the roof 26),
20*b*, 20*c*. (fabrics forming, respectively, the side walls 22 and 24, and, partially, the roof 26),
21. Bottom wall,
22, 23, 24, 25. Side walls,
26. Roof,
27. Filling chute,
28. Emptying chute,
29. Central opening (bottom wall),
30. Vertical edges,
31. Truncated pyramid edges (roof 26),
32. Closing tie (filling chute 27),
33. Closing tie (emptying chute 28),
34. Pouch,
35. Drawstring (pouch),
40. Roller (perforation device with single roller with needles)
50. Roller (perforation with double rollers with needles, contra-rotating)
Lc. Circular lines of needles,
G. Grooves.

The invention claimed is:

1. A bulk storage device (1) intended for powdery materials, said device comprising:
a flexible bulk container (2), the material of the container being an insulator, without antistatic additive or electrically conductive layer,
an insulating inner liner (3), of surface resistivity greater than $1.0\times10^{12}\Omega$, without a static electricity conducting layer and without a static electricity dissipation layer, said inner liner (3) covering the inner walls of the container, the thickness Δ of the inner liner (3) being greater than 60 microns and inferior or equal to 700 microns, said inner liner (3) comprising micro-perforations (4) that pass therethrough, the diameter of the micro-perforations (4) being between 5 microns and 130 microns, the micro-perforations being distributed over the whole surface of said inner liner (3), the density of the micro-perforations on the inner liner (3) being between 0.2 perforations per $cm^2$ and 2 perforations per $cm^2$, and in such a way that the breakdown voltage of said inner liner (3) is lower than 4 kV and in that the breakdown voltage of the wall of the container is lower than 6 kV without requiring the device to be earthed,
such that the storage device can be qualified as a intermediate flexible bulk container classified as type B according to the standard 61340-4-4 Edition 2.0 2012-01.

2. The device as claimed in claim 1, in which the inner liner (3) consists of a single film of material having said micro-perforations (4).

3. The device as claimed in claim 1, in which the inner liner is a multilayer of several different insulators.

4. The device as claimed in claim 1, in which the flexible bulk container (2) is formed from fabric (20).

5. The device as claimed in claim 4, in which the fabric (20) is a coated fabric.

6. The device as claimed in claim 4, in which the fabric (20) is a laminated fabric.

7. The device as claimed in claim 4, in which the fabric (20) is a non-laminated and non-coated fabric.

8. The device as claimed in claim 4, in which the fabric (20) of the flexible bulk container is a fabric permeable to air, preferably non-laminated and non-coated, so as to allow the de-aeration of the device (1) through the micro-perforations (4) of the inner liner (3) and through the fabric (20) of said container (2).

9. The device as claimed in claim 1, in which the density of the micro-perforations (4) over the whole surface of the inner liner (3) is such that two neighboring micro-perforations are separated by a dimension δ less than or equal to 2 cm.

10. The device as claimed in claim 9, in which the maximum surface area of the inner liner not having any micro-perforations must not exceed a disk of 2.5 cm in diameter.

11. The device as claimed in claim 1, in which the diameter of the micro-perforations (4) is between 5 microns and 40 microns.

12. The device as claimed in claim 1, in which the breakdown voltage of the container (2)/inner liner (3) assembly is lower than or equal to 6 kV.

13. The device as claimed in claim 1, in which the thickness Δ of the inner liner (3) is between 90 microns and 700 microns.

14. The device as claimed in claim 13, in which the thickness Δ of the inner liner (3) is between 90 microns and 500 microns.

15. The device as claimed in claim 1, in which the container forms a body comprising a bottom wall (21), four side walls (22 to 25) and a roof (26), said device comprising a flexible filling chute (27), fixed to the roof (26), extending from an opening of the roof, outside the body, and a flexible emptying chute (28), extending from an opening of the bottom wall (21), outside the body and in which the perforated inner liner (3) cover not only the inner walls of the body of the container, but also the inner wall of the filling chute (27) and the inner wall of the emptying chute (28).

16. The device as claimed in claim 15, in which the perforated inner liner (3) covering not only the inner walls of the body of the container, the inner wall of the filling chute (27) and the inner wall of the emptying chute (28) consists of a gusset sheath, of a single piece, extending lengthwise, from the filling chute (27) to the emptying chute (28).

17. The device as claimed in claim 1, in which the distribution of the micro-perforations (4) over the inner liner is uniform.

18. The device as claimed in claim 17, in which the micro-perforations (4) are arranged in parallel lines, the micro-perforations of each line being separated by a constant distance between any two successive micro-perforations of the line, and in which the perforations of two successive lines are arranged staggered relative to one another.

19. The device as claimed in claim 1, in which the material of the container (2) and/or the material of the inner liner (3) are chosen from polyethylene, polypropylene, polyamide, PET and a biopolymer.

20. A method for manufacturing a bulk storage device (1) for powdery materials, said device comprising:
a flexible bulk container (2), the material of the container being an insulator, without antistatic additive or electrically conductive layer, and
an insulating inner liner (3), of surface resistivity greater than $1.0\times10^{12}\Omega$, without a static electricity conducting layer and without a static electricity dissipation layer, said inner liner (3) covering the inner walls of the container, the thickness Δ of the inner liner (3) being greater than 60 microns and inferior or equal to 700 microns, said method comprising a step of microperforating said inner liner (3) with micro-perforations (4) that pass therethrough, the diameter of the micro-perforations (4) being between 5 microns and 130 microns, the micro-perforations being distributed over the whole surface of said inner liner (3), the density of the micro-perforations on the inner liner (3) being between 0.2 perforations per $cm^2$ and 2 perforations per $cm^2$, and in such a way that the breakdown voltage of said inner liner (3) is lower than 4 kV and in that the breakdown voltage of the wall of the container is lower than 6 kV without requiring the device to be earthed, such that the storage device can be qualified as an intermediate flexible bulk container classified as type B according to the standard 61340-4-4 Edition 2.0 2012-01.

21. The method for manufacturing a device as claimed in claim 20, in which the micro-perforated inner liner is obtained from a non-perforated inner liner and by means of a perforation device comprising at least one roller provided, on its circumference, with needles, driven in rotation about its axis and rolling over the inner liner while perforating same.

22. The method as claimed in claim 21, in which the perforation device comprises two contra-rotating rollers, each provided with needles on its circumference, driven in counter rotations, the two rollers rolling over the inner liner while perforation same.

23. The method as claimed in claim 21, in which the micro-perforations are produced from a gusset sheath (6), directly in the gusset sheath, when the sheath is flat, in the form of a strip.

* * * * *